US008746112B2

(12) United States Patent
Perry et al.

(10) Patent No.: US 8,746,112 B2
(45) Date of Patent: Jun. 10, 2014

(54) TOOL FOR OPERATING OXYGEN TANKS

(76) Inventors: Lynne Perry, Bowling Green, OH (US); Bradley Ruff, Bowling Green, OH (US)

( * ) Notice: Subject to any disclaimer, the term of this patent is extended or adjusted under 35 U.S.C. 154(b) by 287 days.

(21) Appl. No.: 13/353,726

(22) Filed: Jan. 19, 2012

(65) Prior Publication Data

US 2012/0186404 A1 Jul. 26, 2012

Related U.S. Application Data

(60) Provisional application No. 61/434,626, filed on Jan. 20, 2011.

(51) Int. Cl.
*B25B 13/48* (2006.01)
*B25F 1/00* (2006.01)
*B25B 23/00* (2006.01)

(52) U.S. Cl.
CPC . *B25B 13/48* (2013.01); *B25F 1/00* (2013.01); *B25B 23/00* (2013.01)
USPC ..... 81/176.1

(58) Field of Classification Search
CPC ..... B25B 13/02; B25B 13/06; B25B 13/48; B25B 13/50; B25B 13/5091
USPC ..... 81/176.2, 119, 121.1, 124.2, 124.3, 81/124.6, 124.7, 176.1
See application file for complete search history.

(56) References Cited

U.S. PATENT DOCUMENTS

| | | | | | |
|---|---|---|---|---|---|
| D130,756 | S | * | 12/1941 | Howard | D8/17 |
| 4,664,000 | A | * | 5/1987 | Bainbridge | 81/451 |
| 4,860,618 | A | * | 8/1989 | Givot | 81/121.1 |
| 5,195,667 | A | * | 3/1993 | Gallant | 224/197 |
| D353,755 | S | * | 12/1994 | Lane | D8/17 |
| 6,062,110 | A | * | 5/2000 | Julio et al. | 81/124.2 |
| 6,076,435 | A | | 6/2000 | White, Sr. et al. | |
| 6,450,069 | B1 | | 9/2002 | Brahmbhatt | |
| D472,777 | S | * | 4/2003 | Halstead | D8/28 |
| 6,739,224 | B1 | * | 5/2004 | Wershe | 81/437 |
| 7,117,766 | B1 | * | 10/2006 | Boehringer | 81/121.1 |
| D576,851 | S | * | 9/2008 | Zeyfang | D8/21 |
| 8,047,102 | B2 | * | 11/2011 | Gnatz | 81/124.2 |
| 8,087,639 | B1 | * | 1/2012 | Knapp | 251/235 |
| 2011/0119834 | A1 | * | 5/2011 | Steineckert et al. | 7/128 |
| 2011/0247953 | A1 | * | 10/2011 | Edwards | 206/373 |

* cited by examiner

*Primary Examiner* — David B Thomas
(74) *Attorney, Agent, or Firm* — MacMillan, Sobanski & Todd, LLC

(57) ABSTRACT

This invention relates to tool for use in turning a valve stem of a gas cylinder. The tool includes a body having a first end and a second end. The body defines a longitudinal axis. The first end includes a slot formed therein defining a pair of opposed walls. The second end includes a bore formed therein which extends in a direction parallel to the longitudinal axis of the body.

18 Claims, 4 Drawing Sheets

TOOL FOR OPERATING OXYGEN TANKS

CROSS-REFERENCE TO RELATED APPLICATIONS

This application claims the benefit of U.S. Provisional Application No. 61/434,626, filed Jan. 20, 2011, the disclosure of which is incorporated herein by reference.

BACKGROUND OF THE INVENTION

This invention relates in general to tools, and in particular to a tool for opening and closing a valve on gas cylinders, such as portable medical oxygen tanks (also referred to as oxygen cylinders).

Oxygen tanks enable consumers with breathing disorders to receive a measured dosage of oxygen. Portable oxygen tanks enable the patient to travel beyond a hospital, home, or care facility by carrying a supply or source of oxygen with them. Portable oxygen tanks come in various sizes. Some are small hand held devices while others are larger and often times mounted on a wheeled cart for ease of moving the oxygen tank. Typically, these portable oxygen tanks include a gas cylinder, a regulator, a flow control valve, a flow meter, a pressure gauge, and a cannula. The gas cylinders are usually light weight steel or aluminum cylindrical containers for storing the compressed gas (such as oxygen). Because a typical oxygen consumer may have multiple health concerns that cause them to be weak and not have good hand dexterity, they are often unable to independently use the oxygen as ordered by a physician.

Some conventional oxygen tanks may come equipped with a wheel or handle attached to a valve stem of a regulator assembly such that a tool is not required, while other tanks may not be provided with a handle and thus require the use of a tool to turn the valve stem. For those tanks with a handle, the valve stem is opened and closed by manually grasping the handle and turning the stem about its longitudinal axis in the appropriate rotational direction to open or close the valve. The small handles are often difficult to manually operate especially for patients having limited strength and motion with their hands. Often times new or recently charged oxygen tanks have been tightly closed to avoid any leakage prior to using the oxygen tanks. These can be difficult to initially open when the consumer uses the tank for the first time. Another problem that sometimes occurs is that the consumer will not fully close the valve because of its difficult operation, thereby permitting the oxygen to escape even though the consumer believes that they have closed the tank. Some other gas cylinders are simply supplied with a bare valve stem. A tool is generally required to grasp and turn the valve stem. The valve stems of the gas cylinders typically have a square or rectangular cross section. Sometimes consumers will incorrectly use a conventional wrench or other tool and damage the valve stem and/or the regulator assembly.

It is therefore desirable to have a tool or wrench which is easily operable to assist the consumer in operating a variety of portable oxygen tanks.

SUMMARY OF THE INVENTION

This invention relates to tool for use in turning a valve stem of a gas cylinder. The tool includes a body having a first end and a second end. The body defines a longitudinal axis. The first end includes a slot formed therein defining pair of opposed walls. The second end includes a bore formed therein which extends in a direction parallel to the longitudinal axis of the body.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
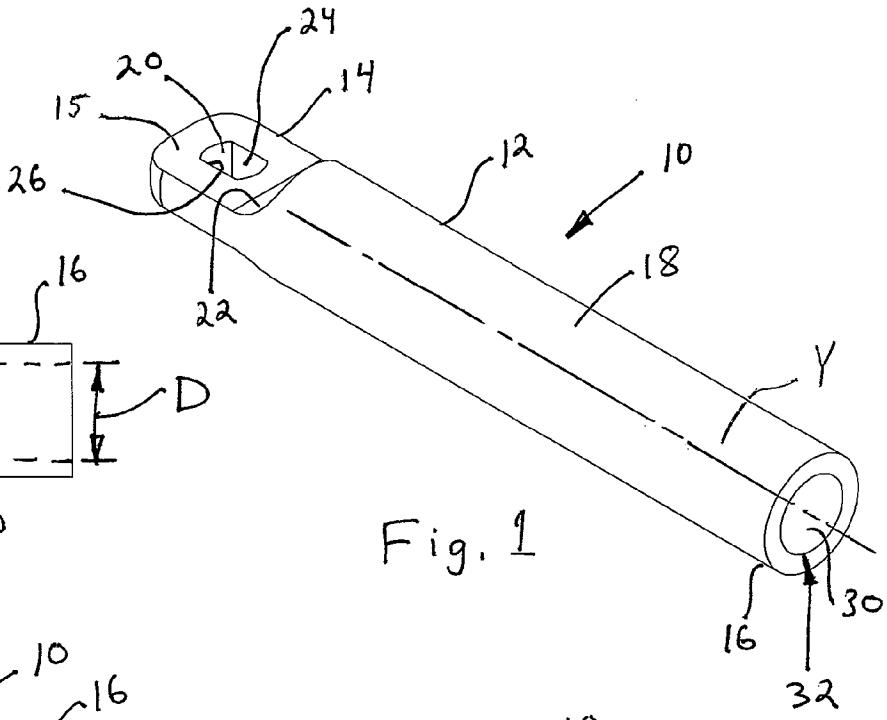
FIG. 1 is a perspective view of a tool which may be used for operating oxygen tanks.
Figure 4:
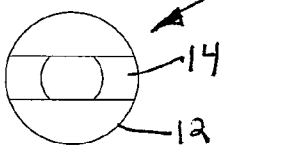
FIG. 4 is an elevational end view of the tool of FIG. 1.
Figure 2:
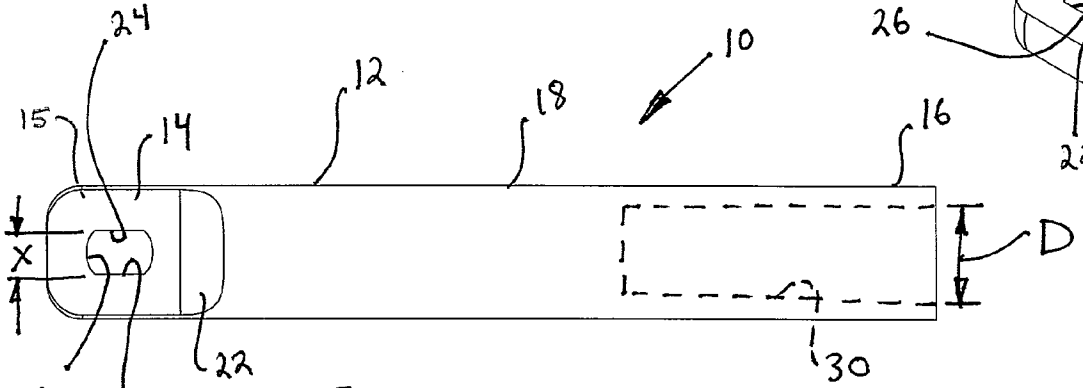
FIG. 2 is a top plan view of the tool of FIG. 1.
Figure 3:
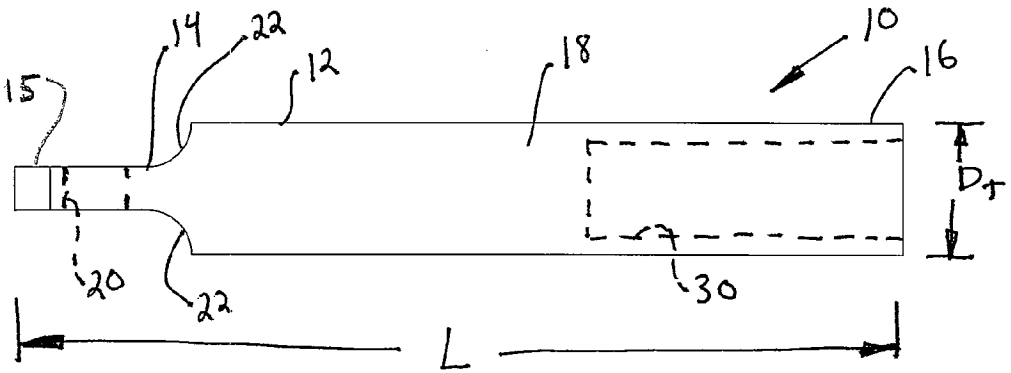
FIG. 3 is an elevational side view of the tool of FIG. 1.

Referring now to the drawings, there is illustrated in FIG. 1 a tool, indicated generally at 10. As will be discussed below, the tool 10 can be used for turning a valve stem of a gas cylinder (such as those described and shown with respect to FIGS. 5 and 6). The tool 10 may be formed from a single integrally formed part or may be made from a combination of components connected together. The tool 10 may be made of any suitable material such as plastic, metal, or wood, and can be manufactured by any suitable manufacturing process. One example includes a single integrally formed tool formed from a plastic injection molding operation. Alternatively, multiple injection molded parts may be later joined together such as by a gluing or a welding process. Other examples of manufacturing include casting and machining, such as milling and turning.

As shown in the Figures, the tool 10 includes a body 12. The body 12 may be configured as an elongated cylindrical defining a longitudinal axis Y and having a diameter DT. However, it should be understood that the body 12 may have any suitable shape, such as a flat plate-like shape or a non-elongated shape. The body 12 generally includes a first end 14, a second end 16, and a central portion 18. The first end 14 includes a flat planar portion 15 have a reduced thickness compared to the central portion 18. If desired, the first end 14 can have a cylindrical shape similar to the central portion 18 or can have any other suitable shape. A slot 20 is formed through the first end 14. The slot 20 may be formed completely through the first end 14 (as shown) or extend only a portion of the way into the first end 14 of the body 12. As shown in FIGS. 1 through 4, curved shoulder portions 22 may be formed between the first end 14 and the central portion 18 of the body 12, however, such a shape is not required. The slot 20 may define a pair of opposed flat walls 24 and 26 spaced from one another by a dimension X.

As shown in FIGS. 1 through 4, the second end 16 of the tool 10 has a cylindrical shape, although it should be understood that the second end 16 need not be cylindrically shaped. A bore 30 is formed in the second end 16 of the tool 10 to define an opening 32. In the illustrated embodiment, the bore 30 is cylindrical and the opening 32 is circular having a diameter D. The bore 30 can have any length extending into any portion of the central portion 18 and first end 14 of the body 12. The bore 30 may have a continuous cylindrical inner surface or may have any other suitable shape to assist in operating a gas cylinder, as will be explained below. The bore 30 may define an axis that is coaxial with the longitudinal axis Y of the body 12. Alternatively, the bore 30 may extend along an axis that is offset from the longitudinal axis Y of the body. The axis of the offset bore 30 may be parallel to the longitudinal axis Y of the body.

Figure 5:
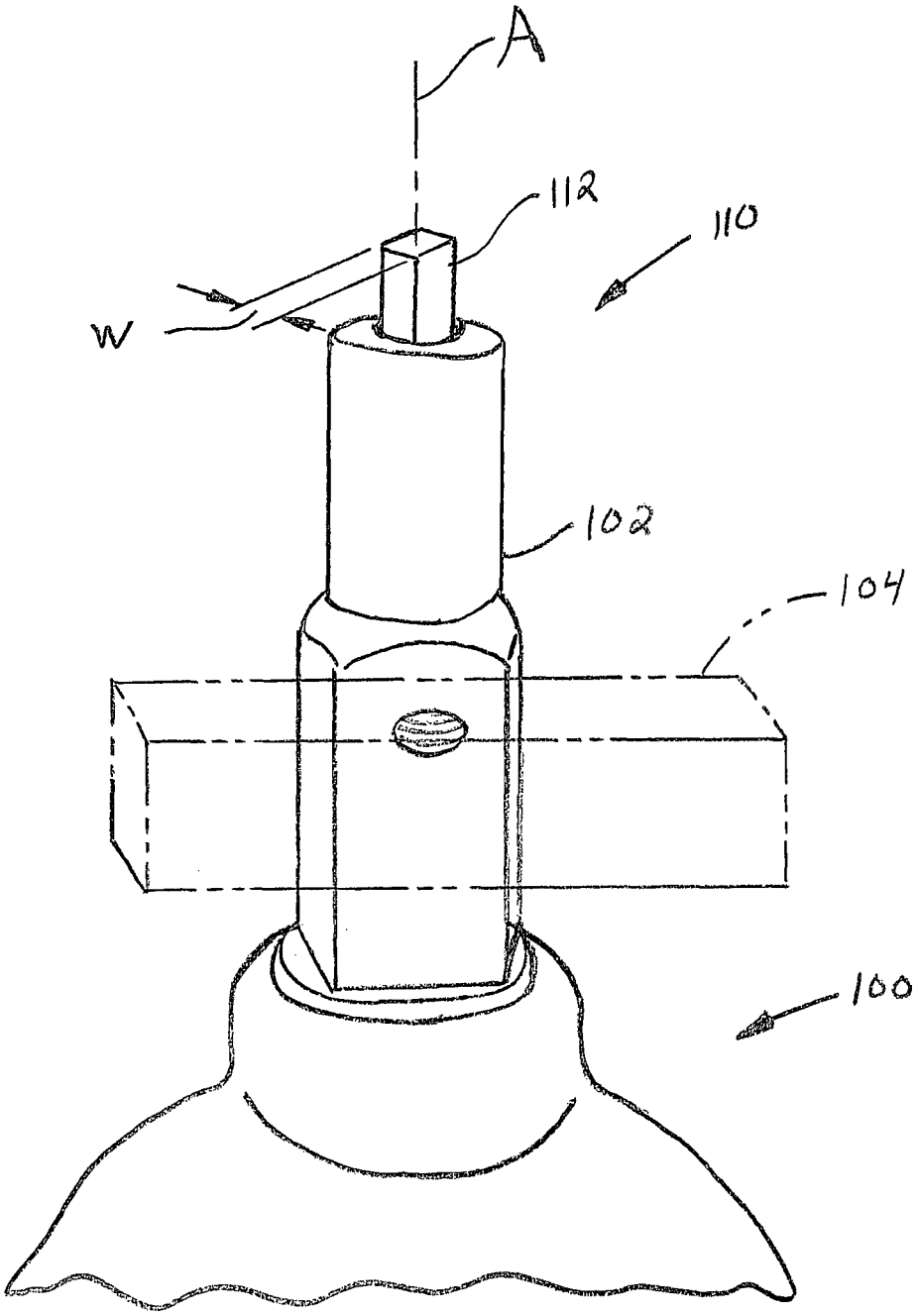
FIG. 5 is a perspective view of an upper portion of a gas cylinder.

Referring to FIG. 5, there is illustrated an example of an upper portion of a gas cylinder, indicated generally 100. As will be explained below, the tool 10 may be used to assist a consumer in operating the gas cylinder 100. The cylinder 100 includes a cylinder stem 102 extending upwardly from the main body of the cylinder 100. A regulator assembly, indicated schematically by broken lines 104, may be mounted on the cylinder stem 102. The cylinder stem 102 can include various passageways and ports for connecting to the regulator assembly 104. The regulator assembly 104 controls the flow and amount of gas or oxygen exiting the tank to a cannula, for example. The regulator assembly 104 may include a flow control valve (not shown) and a flow meter (not shown) for regulating and measuring the oxygen exiting the tank, commonly displayed in liters per minute. The regulator assembly 104 may further include a pressure gauge (not shown) for displaying the remaining amount of oxygen left in the cylinder. When using the tank to assist in breathing, the patient will often use a mask or nasal cannula (not shown) connected to the regulator assembly 104 via a thin long tube through which the oxygen is supplied.

The cylinder stem 102 of the gas cylinder 100 includes a valve assembly or on/off valve, indicated generally at 110, which is typically operated by manually turning a valve stem 112 connected to the valve assembly 110. The valve stem 112 extends outwardly from the cylinder stem 102 and is rotatably mounted to the cylinder stem 102. The valve assembly 110 is an on/off valve for delivering or shutting off the flow of gas from the cylinder to the regulator assembly 104. The valve stem 112 is turned or rotated along a vertical longitudinal axis A as shown in FIG. 5. Turning the valve stem 112 about its longitudinal axis A operates various components within the valve assembly 110 to permit or restrict the flow of gas to the regulator assembly 104.

The valve stem 112 may have a square or rectangular cross section defining a width W. The spacing between the opposed flat walls 24 and 26 of the first end 14 of the tool 10, indicated by dimension X in FIG. 2, generally corresponds to the width W of the valve stem 112. The shape of the slot 20 of the first end 14 is preferably formed such that it can receive the shape of a mating a valve stem 112 to enable turning thereof (such as for example the valve stem 112 described above). To use the first end 14 of the tool 10, the tool 10 is inserted onto the valve stem 112 such that the valve stem 112 extends through the slot 20. Once inserted, the tool 10 can be moved to rotate the valve stem 112 about its longitudinal axis A in an appropriate rotational direction to open or close the valve assembly of the regulator assembly 104. If desired, a length L of the body 12 can be relatively long so that the patient has a large mechanical advantage (moment arm) for applying a torque to the valve stem. It has been found that a length L of four inches or longer is sufficient to provide a desired mechanical advantage. The length L of the body 12 can be any suitable length and is not limited to the length L of the body 12 as shown in FIGS. 1 through 4.

Figure 6:
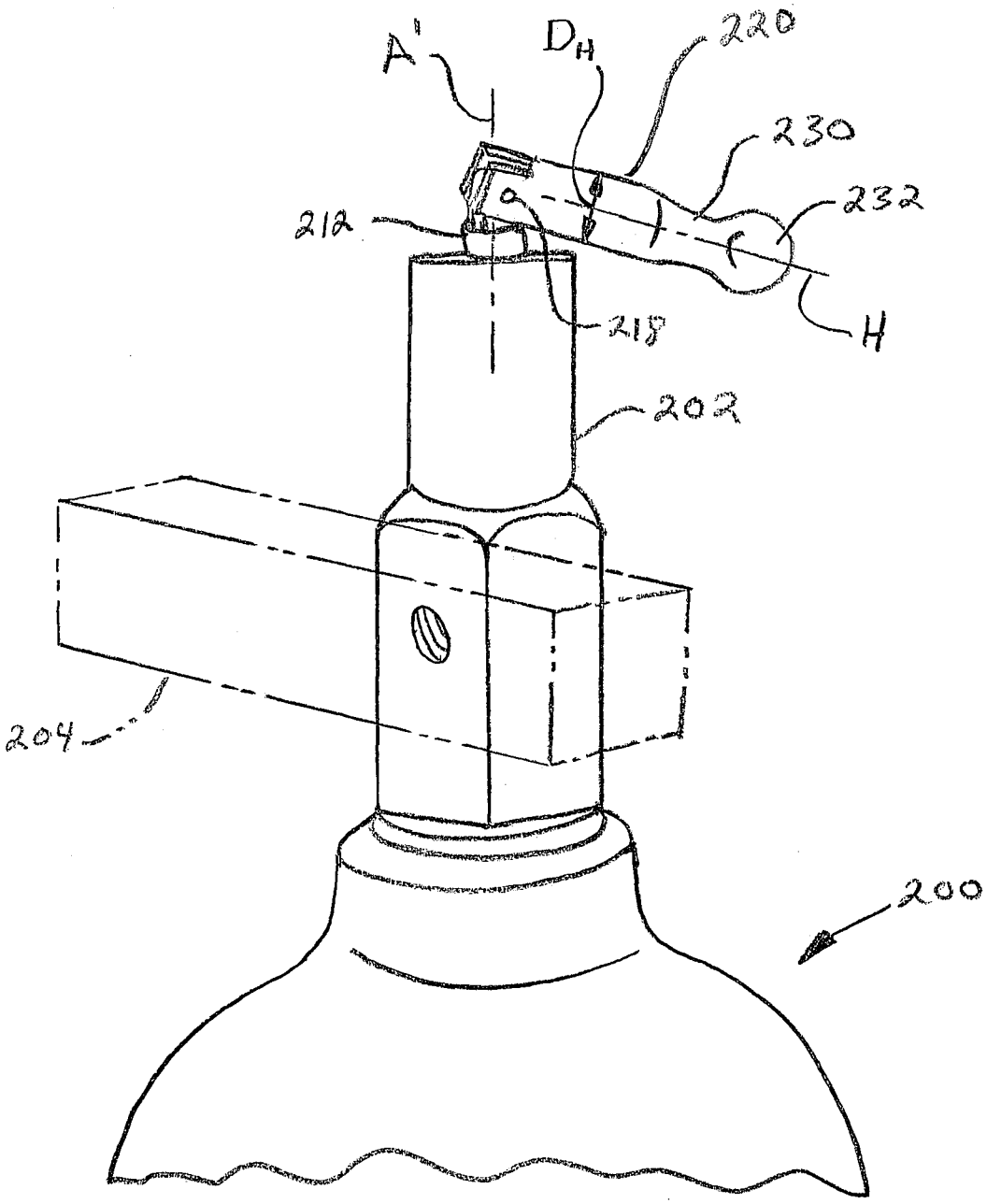
FIG. 6 is a perspective view of an upper portion of alternate type of a gas cylinder.

There is illustrated in FIG. 6, an alternate type of a gas cylinder 200. The gas cylinder 200 is similar to the gas cylinder 100 and includes a valve stem 212 extending upwardly from and rotatable relative to a cylinder stem 202. The cylinder stem 202 is connected to a regulator assembly, indicated schematically by broken lines 204, in a similar manner as the gas cylinder 100. The gas cylinder 200 further includes a handle 220 pivotally mounted to the valve stem 212 at a pivot point 218. The handle 220 is in the form of an elongated cylindrical rod generally having a diameter $D_H$. The generally cylindrical handle 220 defines a longitudinal axis H. The handle 220 need not be completely cylindrical along its length. For example, as shown in FIG. 6, the handle 220 includes a necked down portion 230 and a spherical end 232. The pivot point 218 can be any suitable pivotal connection between the handle 220 and the valve stem 212.

Referring to FIG. 6, the handle 220 is shown at a generally right angle with respect to a longitudinal axis A' of the valve stem 212. Similar to the valve stem 112, the valve stem 212 is rotatable about the longitudinal axis A' for opening and closing an associated valve assembly (not shown) of the gas cylinder 200. The handle 220 may be pivoted to a right angle with respect to the longitudinal axis A' so that the valve stem 212 can be manually turned by the consumer. Although this design of the gas cylinder 200 may be operated without the use of a secondary tool, the relatively small size of the pivoting handle 220 may cause difficulty in manually operating this handle 220 especially for consumers having limited strength and motion of their hands.

The second end 16 of the tool 16 is particularly useful for operating the gas cylinder 200. In use, the tool 10 is positioned such that the elongated handle 220 is disposed into the bore 30 of the second end 16 of the tool 10. Once inserted, the tool 10 may be moved to a position such that the handle 220 and the tool 10 are at a generally right angle with respect to the longitudinal axis A'. The tool 10 can then be moved to rotate the valve stem 212 about its longitudinal axis A' in an appropriate rotational direction to open or close the valve assembly. The tool 10 is essentially increasing the length of the elongated handle so that the patient has an increased mechanical advantage (moment arm) for applying a torque to the valve stem 212. Additionally, it is easier to grasp and maneuver the tool 10 as compared to the relatively small elongated handle 220 mounted on the valve stem 212. It may be desirable to configure the tool 10 such that the diameter D of the opening 32 is just slightly larger than the outer diameter $D_H$ of the elongated handle 220 of the valve stem to provide ease of insertion while providing a relatively secure reduced slack fit between the handle 220 and the bore 30. The bore 30 may have any suitable depth and may be as long or longer than the length of the handle 220

It should be understood that the shape of the bore 30 may be cylindrical, as shown in FIGS. 1 through 4, or have any other desired shape which accommodates the shape of the handle 220. In the illustrated embodiment, the bore 30 is shaped and sized to accommodate the cylindrical shape of the handle 220. However, the bore 30 may have a rectangular cross-sectional shape corresponding to the diameter of the handle 220. To accommodate different sized or shaped handles, the tool 10 may include features to alter the dimensions between the bore 30 and the handle 220 of the valve stem 212. For example, for smaller valve stem handles, inserts (not shown) may be inserted into the bore 30 for reducing the diameter or size of the bore 30 to accommodate and secure smaller sized handles. Alternatively, the tool 10 may also be equipped with movable pins (not shown) or the like that are movable within the bore 30 to effectively reduce its diameter or size to accommodate handles of differing sizes or shapes. The tool 10 may also includes features (not shown), such as set screws or other retaining devices, to secure the tool 10 to the handle of the valve stem.

The outer surface of the tool 10 can have any textured or non-textured surface for aiding in gripping the tool 10. For example, a portion of the tool 10 can include an elastomeric layer (not shown) to form a non-slip grip surface. The outer surface of the tool 10 may also include insignia indicating the manufacture's name or other company's name for promotional purposes. The insignia can be added onto the tool 10 by any suitable matter such as by printing, molding. machining, etching, or labeling.

Figure 7:
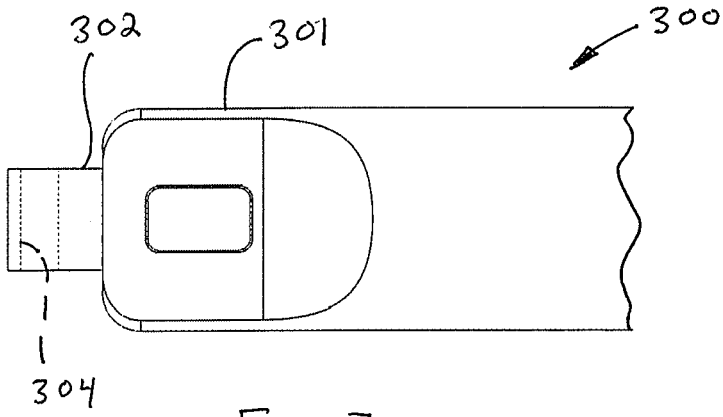
FIG. 7 is a top plan view of an end portion of a second embodiment of a tool.
Figure 8:
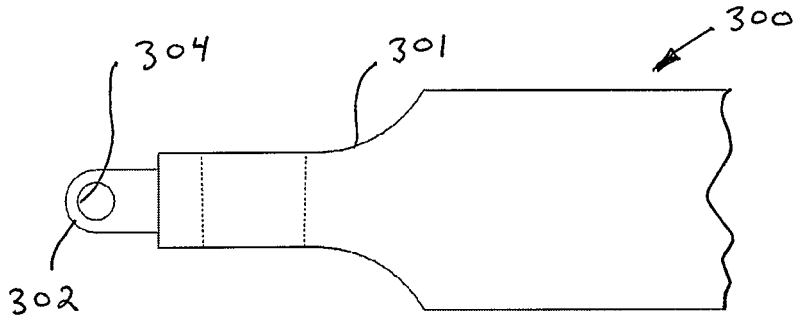
FIG. 8 is an elevational side view of the end portion of the tool of FIG. 7.

There is illustrated in FIGS. 7 and 8, a second alternate embodiment of a tool, indicated generally at 300. Note that only a first end 301 of the tool 300 is shown in FIGS. 7 and 8. The tool 300 is similar to the tool 10 but includes a lanyard attachment tab 302 extending from one end of the tool 300. The tab 302 includes a hole 304 extending therethrough for receiving a lanyard, cord, or other device for ease of carrying the tool 300 or for securing the tool 300 to a gas cylinder, for example. It should be understood that the tab 302 may be attached or integrally formed to any portion of the tool 300 and is not limited to the location shown in the illustrated embodiment. Instead of a tab 302 or other structure, the tool 300 can simple include a hole, bore or hook portion (not shown) formed anywhere on the tool 300 for receiving a lanyard or cord.

Figure 9:
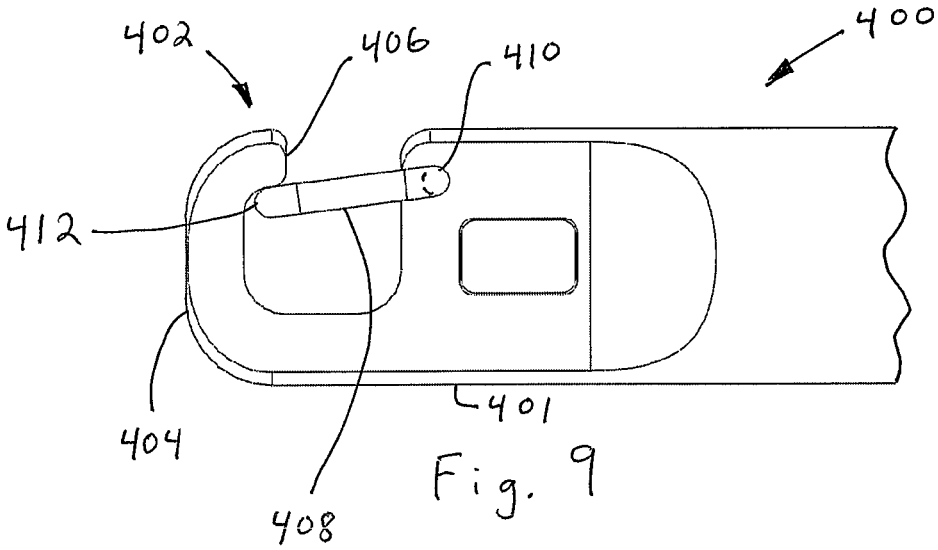
FIG. 9 is an elevational side view of an end portion of third embodiment of a tool.

There is illustrated in FIG. 9, a third alternate embodiment of a tool, indicated generally at 400. Note that only a first end 401 of the tool 400 is shown in FIG. 9. The tool 400 is similar to the tools 10 and 300 but includes spring loaded clip assembly, indicated generally at 402. The assembly 402 includes a hook portion 404 which may be integrally formed in the end portion of the tool 400 or separately attached thereto. The hook portion 404 defines a slot or opening 406. A spring clip 408 is pivotally attached to the tool 400 at a pivot point 410 and includes an end 412 which engages an inside portion of the hook portion 404. The spring clip 408 is shown in a closed position in FIG. 9 and is movable to an open position by pivoting the spring clip 408 counterclockwise, as viewing FIG. 9, to expose the hook portion 404. The clip assembly 402 can be used for receiving a lanyard, cord, or other device for ease of carrying the tool 400 or for securing the tool 400 to a gas cylinder or other device. The spring clip 408 can be spring biased to its closed position. It should be understood that the assembly 402 may be attached or integrally formed to any portion of the tool 400 and is not limited to the location shown in the illustrated embodiment.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A tool for turning a valve stem, said tool comprising:

a body having a first end and a second end, wherein said body defines a longitudinal axis;

wherein said first end includes a flat planar portion having a slot formed through the flat planar portion, and wherein said slot defines a pair of opposed walls, and wherein said slot extends in a transverse direction relative to the longitudinal axis of the body; and wherein said second end has a bore formed therein which extends in a direction parallel to said longitudinal axis of said body.

2. The tool of claim 1, wherein said bore defines an axis that is coaxial with said longitudinal axis of said body.

3. The tool of claim 2, wherein said body and said bore are generally cylindrical in shape.

4. The tool of claim 1, wherein said slot is defined in part by a pair of spaced apart planar walls.

5. The tool of claim 4, wherein said slot is generally rectangular in shape.

6. The tool of claim 1, wherein said body includes a central portion between said first and second ends.

7. The tool of claim 6, wherein said second end and said central portion are cylindrical in shape.

8. The tool of claim 1, wherein said first end has a flattened shape.

9. The tool of claim 1 further including a lanyard opening formed therein.

10. The tool of claim 1 further including a clip assembly.

11. The tool of claim 1, wherein said slot extends completely through said first end.

12. A tool for turning a valve stem, said tool comprising:

a body having a first end, a second end, and a central portion between said first and second ends, wherein said central portion and said second end are cylindrical in shape defining a longitudinal axis;

wherein said first end has a flattened shape and includes a slot formed therein defining a pair of opposed planar walls; and wherein said second end includes a cylindrical bore formed therein which is coaxial with respect to said longitudinal axis.

13. A tool for turning a valve stem, said tool comprising:

a body defining a longitudinal axis and including a bore and a slot, wherein said body includes a flat planar portion, and wherein said slot is formed through said flat planar portion, wherein said bore extends in a direction parallel to said longitudinal axis of said body, and wherein said slot defines a pair of opposed walls, and wherein said slot extends in a transverse direction relative to the longitudinal axis of the body.

14. The tool of claim 13, wherein said bore defines an axis that is coaxial with said longitudinal axis of said body.

15. The tool of claim 13, wherein said slot is generally rectangular in shape.

16. The tool of claim 13, wherein said slot extends completely through said flat planar portion.

17. The tool of claim 16, wherein said slot is located at a first end of said body.

18. The tool of claim 17, wherein said first end has a flattened shape.

* * * * *